US010844700B2

(12) United States Patent
Al-Gouhi

(10) Patent No.: US 10,844,700 B2
(45) Date of Patent: Nov. 24, 2020

(54) REMOVING WATER DOWNHOLE IN DRY GAS WELLS

(71) Applicant: Saudi Arabian Oil Company, Dhahran (SA)

(72) Inventor: Alwaleed Abdullah Al-Gouhi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 284 days.

(21) Appl. No.: 16/025,611

(22) Filed: Jul. 2, 2018

(65) Prior Publication Data

US 2020/0003035 A1 Jan. 2, 2020

(51) Int. Cl.

| | |
|---|---|
| ***E21B 43/12*** | (2006.01) |
| ***E21B 33/127*** | (2006.01) |
| ***E21B 43/38*** | (2006.01) |
| ***E21B 47/047*** | (2012.01) |

(52) U.S. Cl.

CPC ..... *E21B 43/128* (2013.01); *E21B 33/127* (2013.01); *E21B 43/38* (2013.01); *E21B 47/047* (2020.05)

(58) Field of Classification Search

None

See application file for complete search history.

(56) References Cited

U.S. PATENT DOCUMENTS

| | | | | |
|---|---|---|---|---|
| 2,519,116 A | | 8/1950 | Crake | |
| 2,671,510 A | | 3/1954 | Slick et al. | |
| 2,696,259 A | | 12/1954 | Greene | |
| 2,804,148 A | | 8/1957 | Schremp et al. | |
| 3,018,828 A | * | 1/1962 | Prentiss | E21B 43/12 166/53 |
| 3,055,424 A | | 9/1962 | Allen | |
| 3,354,955 A | | 11/1967 | Berry | |
| 3,419,080 A | | 12/1968 | Lebourg | |

(Continued)

FOREIGN PATENT DOCUMENTS

| | | |
|---|---|---|
| GB | 2251011 | 6/1992 |
| GB | 2411918 A | 9/2005 |

(Continued)

OTHER PUBLICATIONS

PCT International Search Report and Written Opinion in International Appln. No. PCT/US2019/039819, dated Oct. 14, 2019, 17 pages.

(Continued)

*Primary Examiner* — Shane Bomar

(74) *Attorney, Agent, or Firm* — Fish & Richardson P.C.

(57) ABSTRACT

A tool having a downhole conveyance, a first packer, a second packer, a pump, and a first and second sensor. The pump defines a plurality of inlets and an outlet, wherein the plurality of inlets is aligned with a first plurality of holes in the downhole conveyance, and the outlet oriented in a direction longitudinally opposite the first plurality of holes and the second plurality of holes. The second sensor is longitudinally separated further away from the first plurality of holes than the first sensor and configured to activate the pump when a water level is detected. The first sensor is configured to deactivate the pump when the water level is detected.

18 Claims, 2 Drawing Sheets

(56) References Cited

U.S. PATENT DOCUMENTS 3,438,204 A * 4/1969 Cleary ..... B65D 88/78 405/210
3,495,612 A * 2/1970 Learn ..... F01P 11/02 137/209
4,074,763 A 2/1978 Stevens
4,349,047 A 9/1982 Ditto
4,462,714 A 7/1984 Smith et al.
4,766,957 A 8/1988 McIntyre
5,335,732 A * 8/1994 McIntyre ..... E21B 33/124 166/250.01
5,833,001 A 11/1998 Song et al.
6,102,120 A 8/2000 Chen
6,131,655 A * 10/2000 Shaw ..... E21B 43/12 166/105.5
6,253,850 B1 7/2001 Nazzai et al.
6,336,504 B1 1/2002 Alhanati et al.
6,415,864 B1 * 7/2002 Ramakrishnan ..... E21B 47/047 166/250.03
6,719,048 B1 4/2004 Ramos et al.
6,755,250 B2 6/2004 Hall et al.
6,860,329 B1 3/2005 Oosterling
6,923,275 B2 8/2005 Gardes
7,370,701 B2 5/2008 Suijaatmadja et al.
7,708,081 B2 5/2010 Bosma et al.
8,196,651 B2 * 6/2012 Murphy ..... E21B 43/385 166/186
8,528,632 B2 9/2013 Mack
10,087,708 B2 10/2018 Al-Gouhi
2003/0168211 A1 * 9/2003 Arnaud ..... E21B 43/128 166/68
2005/0199401 A1 9/2005 Patel
2005/0252689 A1 * 11/2005 Gardes ..... E21B 43/006 175/61
2007/0137826 A1 6/2007 Bosma
2007/0260439 A1 11/2007 Keller
2008/0060813 A1 3/2008 Badalamenti et al.
2009/0178809 A1 7/2009 Keller
2009/0183875 A1 7/2009 Rayssiguier et al.
2010/0284828 A1 11/2010 Woie et al.
2012/0055667 A1 3/2012 Ingram
2013/0153207 A1 6/2013 Lauderdale
2015/0267501 A1 9/2015 Al-Gouhi
2016/0084059 A1 3/2016 Moore et al.
2016/0177659 A1 6/2016 Voll

FOREIGN PATENT DOCUMENTS

WO WO1999015755 4/1999
WO WO2002099247 A1 12/2002
WO WO2010127240 A1 11/2010

OTHER PUBLICATIONS

International Search Report and Written Opinion in International Application No. PCT/US2017/051272, dated Nov. 24, 2017, 12 pages.
International Search Report and Written Opinion in PCT/US2015/021680, dated Sep. 11, 2015, 11 pages.

* cited by examiner

REMOVING WATER DOWNHOLE IN DRY GAS WELLS

BACKGROUND

Waste water production with oil and gas is a challenge for the oil and natural gas industry. During the production of oil and natural gas, the oil and natural gas sometimes also includes water. The water produced through wells can originate from the hydrocarbon bearing zones, from aquifers that are near the hydrocarbon bearing zones, or from water that is injected downhole. Various chemicals are sometimes also mixed with the injection water to improve the reservoir sweep efficiency. When produced at the surface, this mixture of water and at least one of oil or gas can create a concern from an environmental standpoint.

In previous solutions, hydrocarbons and water are produced and separated at the surface. In wells that are drilled in to mature reservoirs, the water-cut can become extremely high, reducing the economic viability of the well, sometimes resulting in abandonment of wells. Other existing solutions include blocking the water encroachment by mechanical means, chemicals, controlled production, or some combination of these approaches. Such solutions, however, often adversely compromise the oil production capacity of wells.

SUMMARY

A tool having a downhole conveyance, a first packer, a second packer, a pump, and a first and second sensor. The pump defines a plurality of inlets and an outlet, wherein the plurality of inlets is aligned with a first plurality of holes in the downhole conveyance, and the outlet oriented in a direction longitudinally opposite the first plurality of holes and the second plurality of holes. The second sensor is longitudinally separated further away from the first plurality of holes than the first sensor and configured to activate the pump when a water level is detected. The first sensor is configured to deactivate the pump when the water level is detected.

The details of one or more implementations of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

The present disclosure describes a formation-water removal tool that is operable to remove formation water produced by a one wellbore and inject the formation water into an intersecting wellbore. For example, the tool can inject formation water from a horizontal wellbore into a main wellbore below the location of the horizontal wellbore. The tool, in some aspects, includes tubular conduits affixed to each other and positioned in a wellbore with wellbore seals such as packers. Water from the subterranean zone collects in the annulus formed between tubular conduit and casing and between the wellbore seals. When the water level reaches a predefined level, a pump pumps water from the annulus into the wellbore through holes in the tubular conduit. In doing so, the tool can eliminate, minimize, or otherwise reduce the amount of formation water produced at the surface of the wellbore along with the gas. For example, the tool can be used in a dry gas well and utilize the main wellbore to collect the formation water produced from a horizontally wellbore in the dry gas reservoir. In some instances, the reservoir pressure is above the dew point pressure, which can eliminate or otherwise reduce condensate produced at the surface.

Figure 1:
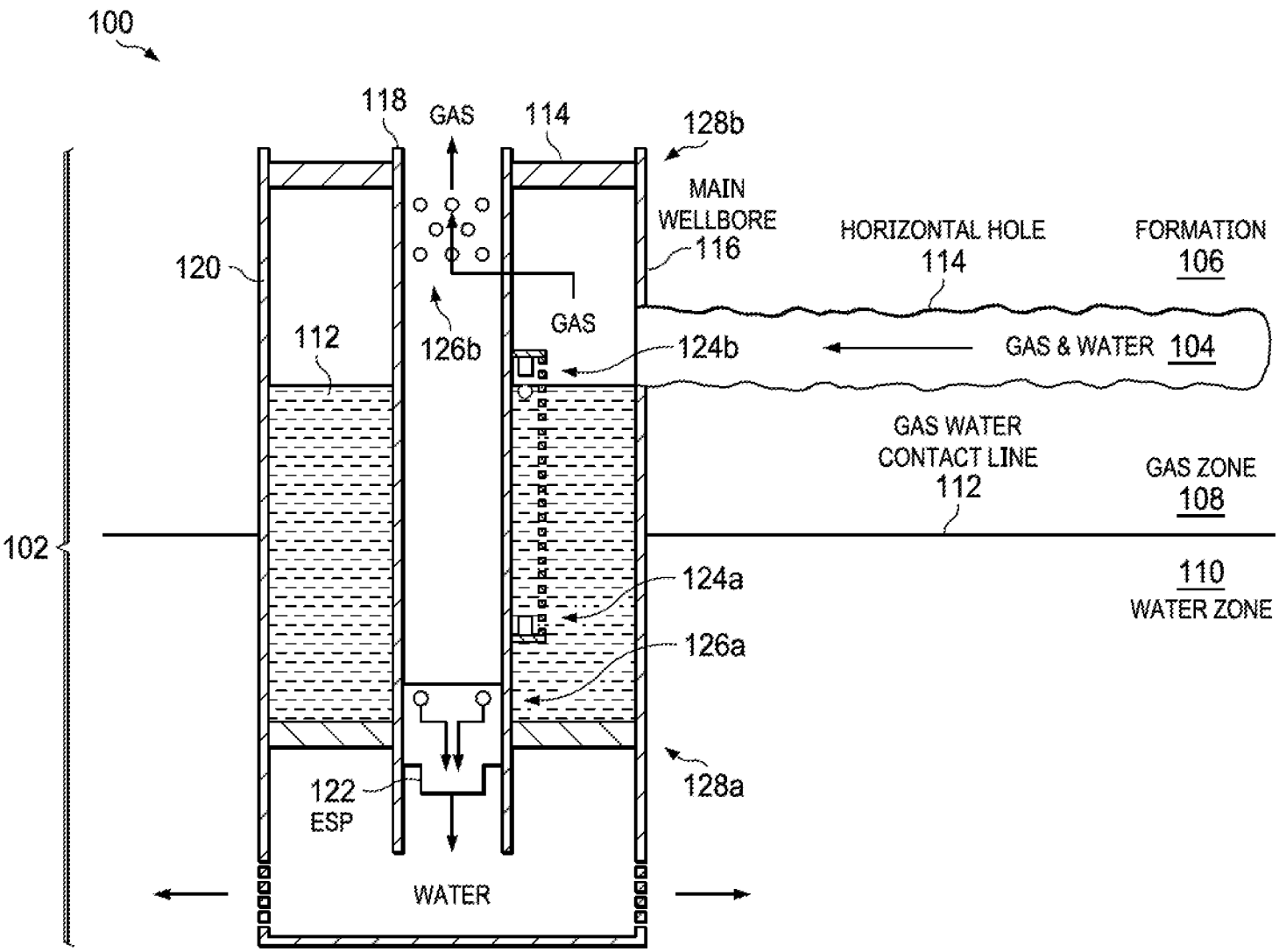
FIG. 1 is a schematic illustration of a wellbore system that includes an example implementation of a formation-water removal tool.

FIG. 1 is a schematic illustration of a wellbore system 100 that includes an example implementation of a formation-water removal tool 102. Generally, FIG. 1 illustrates a portion of a wellbore system 100 according to the present disclosure in which the formation-water removal tool 102 can receive formation water and gas 104 from a formation 106 including a gas zone 108 and a water zone 110 and removes formation water 112 to produced gas 114 at the surface. In some aspects, a main wellbore 108 receives the formation water 112, and the formation water 112 enters the water zone 110.

The formation-water removal tool 102, in some aspects, may direct the flow of water into an annulus formed in the wellbore 116. One or more pumps can pump the water from the annulus into a portion of the wellbore below the formation-water removal tool 102. The gas 114 can flow through a separation tubular to the surface. In some instances, the formation-water removal tool 102 can produce the gas 114 at the surface independent of pumps at the surface which are typically needed for water separation.

As illustrated in FIG. 1, an implementation of the wellbore system 100 includes a downhole conveyance 118 that is operable to convey (for example, run in, or pull out or both) the formation-water removal tool 102 into the wellbore 116. Although not shown, a drilling assembly deployed on the surface may form the wellbore 116 prior to running the formation-water removal tool 102 into the wellbore 116 to a particular location in the formation 106. The wellbore 116 includes the formation-water removal tool 102 that extends from the terranean surface 102 and through one or more geological formations in the Earth including the formation 106. The formation 106 includes the gas zone 108 and the water zone 110 and is located under the terranean surface. As will be explained in more detail below, one or more wellbore casings, such as an intermediate casing 120, may be installed in at least a portion of the wellbore 116.

In some implementations, the wellbore system 100 may be deployed on a body of water rather than the terranean surface. For instance, in some implementations, the terranean surface may be an ocean, gulf, sea, or any other body of water under which hydrocarbon-bearing formations may be found. In short, reference to the terranean surface includes both land and water surfaces and contemplates forming and developing one or more wellbore systems 100 from either or both locations.

In some aspects, the downhole conveyance 118 may be a tubular production string made up of multiple tubing joints. For example, a tubular production string (also known as a production casing) typically consists of sections of steel pipe, which are threaded so that they can interlock together. In alternative aspects, the downhole conveyance 118 may be coiled tubing. Further, in some cases, a wireline or slickline conveyance (not shown) may be communicably coupled to the formation-water removal tool 102.

In some implementations of the wellbore system 100, the wellbore 116 may be cased with one or more casings such as casing 120. In some implementations, the wellbore 116 may be offset from vertical (for example, a slant wellbore). Even further, in some implementations, the wellbore 116 may be a stepped wellbore, such that a portion is drilled vertically downward and then curved to a substantially horizontal wellbore portion. Additional substantially vertical and horizontal wellbore portions may be added according to, for example, the type of terranean surface 102, the depth of one or more target subterranean formations, the depth of one or more productive subterranean formations, or other criteria. For example, a horizontal well that intersects the main wellbore 116 can produce the water and gas 104.

In the illustrated implementation, the formation-water removal tool 102 includes the tubing 118, an electric submersible pump (ESP) 122, a lower sensor 124*a*, an upper sensor 124*b*, a lower seal 128*a*, and an upper seal 128*b*. The tubing 118 includes lower openings 126*a* vertically lower than upper openings 126*b*. In some implementations, the lower openings 126*a*, the upper openings 126*b*, or both can be holes, slots, other appropriates shapes, or a combination thereof without departing from the scope of the disclosure. In addition, the lower openings 126*a*, upper openings 126*b*, or both can be arranged randomly, in a pattern, or a combination of both. In some implementations, the ESP 122 includes one or more inlets, and the lower openings 126*a* can be aligned with the one or more inlets of the ESP 122. The upper openings 126*b* form a passage for the gas 114 to flow into the tubing 118 and then the terranean surface. The ESP 122 can inject the formation water 112 into the main wellbore 116 intermittently or continuously. In regards to intermittent rates, the volume of injected water can be based on the largest possible caging size, the smallest possible production tubing size, the maximum possible separation between the two sensors, as well as other appropriate parameters.

The lower seal 128*a* and the upper seal 128*b* are configured to form a seal between the tubing 118 and the casing 120. In some implementations, the lower seal 128*a* and the upper seal 128*b* are packers such as inflatable packers or mechanical packers. In some implementations, the lower packer 128*a* and the upper packer 128*b* can be separated by 50 feet (ft), 100 ft, 150 ft, or greater. When sealed, the lower seal 128*a*, the upper seal 128*b*, the tubing 118, and the casing 120 can, in some implementations, form an annulus that functions as a receptacle for the formation water 112.

The lower sensor 124*a* and the upper sensor 124*b* detect the water level and turn the ESP 122 on and off. The lower sensor 124*a* is positioned above the lower openings 126*a* to shut off the ESP 122 before the water level is below the lower openings. This standoff distance assist in preventing gas from leaking into the pump intake or opening 126*a* The upper sensor 124*b* is located below opening to the gas zone 108 to turn on the ESP 122 before the water level rises above the lip of the opening In some implementations, the lower sensor 124*a* and the upper sensor 124*b* detects a water level when an object floating on a surface of the formation water 112 contacts either the lower sensor 124*a* or the upper sensor 124*b*. For example, when the upper sensor 124*b* detects contact with the floating object, the upper sensor 124*b* signals the ESP 122 to turn on. When the lower sensor 124*a* detects contact with the floating object, the lower sensor 124*a* signals the ESP 122 to turn off. In doing so, the formation-water removal tool 102 can prevent or otherwise reduce the production of formation water 112 at the surface and gas 114 passing to the main wellbore 116.

Figure 2:
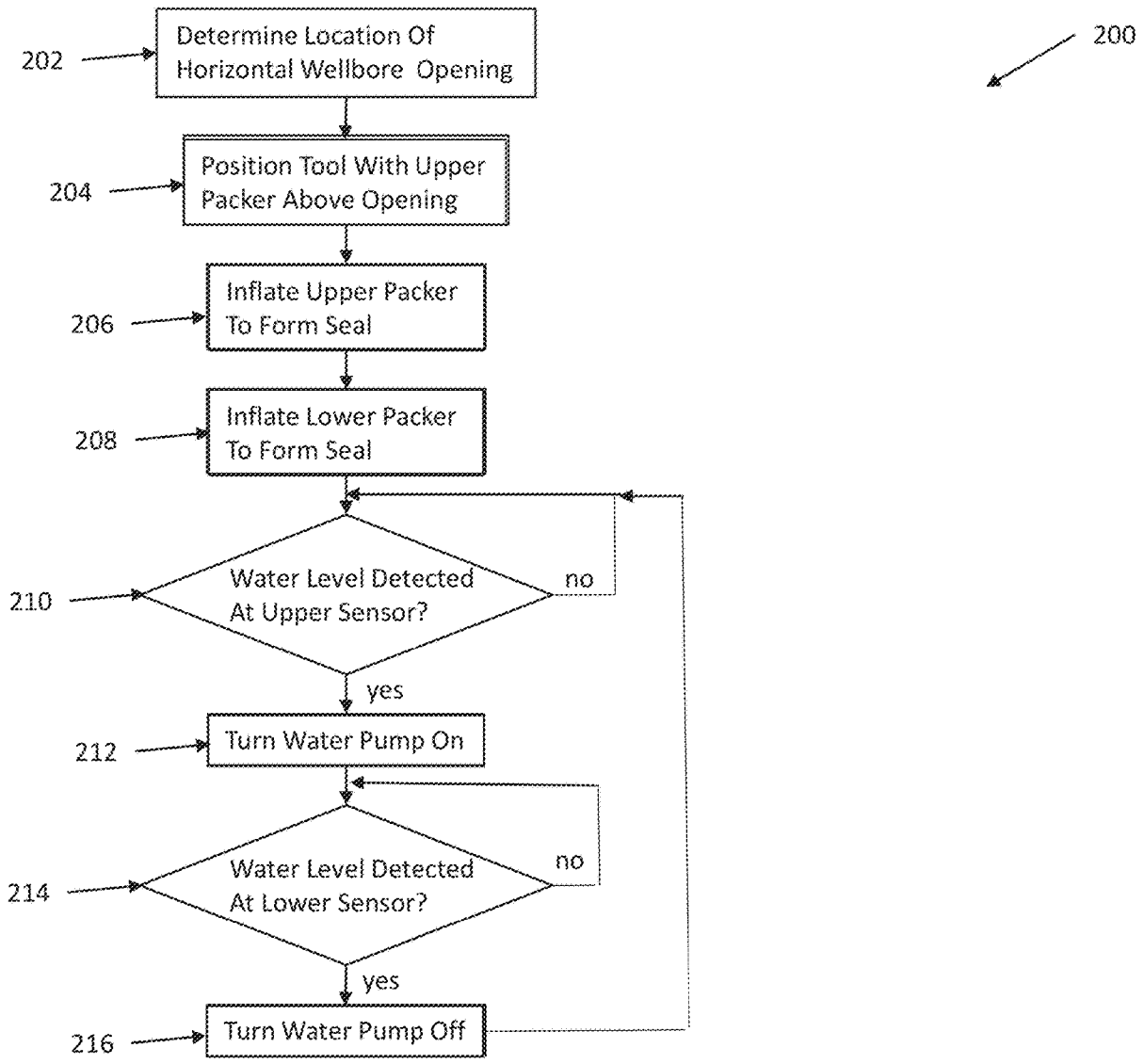
FIG. 2 is a flow chart illustrating an example method for removing water downhole in a dry gas well, in accordance with some implementations of the present disclosure.

FIG. 2 is a flowchart illustrating an example method 200 for removing formation water, according to some implementations of the present disclosure. For clarity of presentation, the description that follows generally describes method 200 in the context of the other figures in this description. However, it will be understood that method 200 can be performed, for example, by any system, environment, software, and hardware, or a combination of systems, environments, software, and hardware, as appropriate. In some implementations, various steps of method 200 can be run in parallel, in combination, in loops, or in any order.

At step 202, a location of an opening to a horizontal wellbore is determined. As previously mentioned, a horizontal wellbore may drilled off the main wellbore and, in this case, the opening distance from the terranean surface is known. Other appropriate techniques can be used to determine the opening location without departing from the scope of the disclosure.

At step 204, the formation-water removal tool is positioned with the upper packer above the opening and the lower packer below the opening. In FIG. 1, the lower packer 128*a* is located below the opening, and the upper packer 128*b* is located above the opening.

At steps 206 and 208, the upper packer and the lower packer are inflated, respectively, when the upper sensor is at or below the lower lip of the opening. Inflating the upper packer 128*b* above the opening and lower packer 128*a* below the opening forms an annulus where formation water can be collected and pumped into the lower portion of the main wellbore 116. In addition, the location of the upper sensor 124*a* at or below the bottom lip can prevent or reduce formation water 112 from returning through the opening and interfering with gas production.

If the water level is detected at the upper sensor at decisional step 210, then, at step 212, the water pump is turned on. If not, the method 200 returns to the decisional step 210. In regards to FIG. 1, if the upper sensor 124*b* determines that the water level has reached that height, the upper sensor 124*b* signals the ESP 122 to turn on. As a result, the formation water 112 is pumped into lower portions of the main wellbore 116 and can return to the water zone 110. In doing so, the water level can be maintained below the lower lip of the opening.

If the water level is detected at the lower sensor at decisional step 214, then, at step 216, the water pump is turned on. If not, the method 200 returns to the decisional step 214. In regards to FIG. 1, if the lower sensor 124*a* determines that the water level has reached that height, the lower sensor 124*b* signals the ESP 122 to turn off. As a result, the formation water 112 is stopped from being pumped into lower portions of the main wellbore 116, and the formation water 112 begins to collect in the annulus again. In doing so, the water level can be maintained above the lower openings 126*a*.

A number of implementations of the invention have been described. Nevertheless, it will be understood that various modifications may be made without departing from the spirit and scope of the invention. Accordingly, other implementations are within the scope of the following claims.

What is claimed is:

1. A tool, comprising:

a downhole conveyance defining a first plurality of holes and a second plurality of holes longitudinally separated from the first plurality of holes;

a first packer affixed to an outer surface of the downhole conveyance and longitudinally separated further from the first plurality of holes than the second plurality of holes;

a second packer affixed to the outer surface of the downhole conveyance and longitudinally separated further from the second plurality of holes than the first plurality of holes;

a pump defining a plurality of inlets and an outlet, wherein the plurality of inlets is aligned with the first plurality of holes, and the outlet oriented in a direction longitudinally opposite the first plurality of holes and the second plurality of holes; and a first sensor and a second sensor affixed to the outer surface and located between the first plurality of holes and the second plurality of holes, the second sensor longitudinally separated further away from the first plurality of holes than the first sensor and configured to activate the pump when a water level is detected, and the first sensor configured to deactivate the pump when the water level is detected.

2. The tool of claim 1, wherein the downhole conveyance is a production string.

3. The tool of claim 1, wherein the first packer and the second packer are inflatable packers.

4. The tool of claim 1, wherein the downhole conveyance, the first packer, the second packer form an annulus when engaged with a downhole casing.

5. The tool of claim 1, further comprising:

a porous housing defining an inner volume; and a floatable object, wherein the floatable object, the first sensor, and the second sensor are located within the inner volume, and the first sensor and the second sensor detect contact with the floatable object.

6. The tool of claim 1, wherein the pump comprises an electric submersible pump.

7. A method, comprising:

positioning in a wellbore a downhole conveyance defining a first plurality of holes and a second plurality of holes longitudinally separated from the first plurality of holes, wherein the wellbore intersects a horizontal wellbore;

engaging a first packer below an opening of the horizontal wellbore, the first packer affixed to an outer surface of the downhole conveyance and longitudinally separated further from the first plurality of holes than the second plurality of holes;

engaging a second packer above the opening of the horizontal wellbore, the second packer affixed to the outer surface of the downhole conveyance and longitudinally separated further from the second plurality of holes than the first plurality of holes;

in response to a second sensor detecting a water level, activating a pump defining a plurality of inlets and an outlet, wherein the plurality of inlets is aligned with the first plurality of holes, and the outlet oriented in a direction longitudinally opposite the first plurality of holes and the second plurality of holes; and in response to a first sensor detecting the water level, deactivating the pump, wherein the first sensor and the second sensor affixed to the outer surface and located between the first plurality of holes and the second plurality of holes, the second sensor longitudinally separated further away from the first plurality of holes than the first sensor.

8. The method of claim 7, wherein the downhole conveyance is a production string.

9. The method of claim 7, wherein the first packer and the second packer are inflatable packers.

10. The method of claim 7, wherein the downhole conveyance, the first packer, the second packer form an annulus when engaged with a downhole casing.

11. The method of claim 7, wherein the first sensor and the second sensor are located within an inner volume of a porous housing, and the first sensor and the second sensor detect contact with a floatable object in the inner volume.

12. The method of claim 7, wherein the pump comprises an electric submersible pump.

13. An apparatus, comprising:

one or more processors; and a non-transitory computer-readable storage medium coupled to the one or more processors and storing programming instructions for execution by the one or more processors, the programming instructions instruct the one or more processors to perform operations comprising:

positioning in a wellbore a downhole conveyance defining a first plurality of holes and a second plurality of holes longitudinally separated from the first plurality of holes, wherein the wellbore intersects a horizontal wellbore;

engaging a first packer below an opening of the horizontal wellbore, the first packer affixed to an outer surface of the downhole conveyance and longitudinally separated further from the first plurality of holes than the second plurality of holes;

engaging a second packer above the opening of the horizontal wellbore, the second packer affixed to the outer surface of the downhole conveyance and longitudinally separated further from the second plurality of holes than the first plurality of holes;

in response to a second sensor detecting a water level, activating a pump defining a plurality of inlets and an outlet, wherein the plurality of inlets is aligned with the first plurality of holes, and the outlet oriented in a direction longitudinally opposite the first plurality of holes and the second plurality of holes; and in response to a first sensor detecting the water level, deactivating the pump, wherein the first sensor and the second sensor affixed to the outer surface and located between the first plurality of holes and the second plurality of holes, the second sensor longitudinally separated further away from the first plurality of holes than the first sensor.

14. The apparatus of claim 13, wherein the downhole conveyance is a production string.

15. The apparatus of claim 13, wherein the first packer and the second packer are inflatable packers.

16. The apparatus of claim 13, wherein the downhole conveyance, the first packer, the second packer form an annulus when engaged with a downhole casing.

17. The apparatus of claim 13, wherein the first sensor and the second sensor are located within an inner volume of a porous housing, and the first sensor and the second sensor detect contact with a floatable object in the inner volume.

18. The apparatus of claim 13, wherein the pump comprises an electric submersible pump.

* * * * *